US005601066A

United States Patent [19]

Qutub

[11] Patent Number: 5,601,066

[45] **Date of Patent: *Feb. 11, 1997**

[54] FUEL SYSTEM FOR HEATING AND COOLING FUEL

[75] Inventor: Ibrahim Qutub, Beaverton, Oreg.

[73] Assignee: Freightliner Corporation, Portland, Oreg.

[ * ] Notice: The term of this patent shall not extend beyond the expiration date of Pat. No. 5,533,486.

[21] Appl. No.: 559,466

[22] Filed: Nov. 15, 1995

Related U.S. Application Data

[63] Continuation of Ser. No. 173,667, Dec. 23, 1993, Pat. No. 5,533,486.

[51] Int. Cl.[6] ..... F02M 15/00

[52] U.S. Cl. ..... 123/541; 123/514

[58] Field of Search ..... 123/514, 541, 123/557, 510, 512, 509; 137/572, 569, 590, 592, 604

[56] References Cited

U.S. PATENT DOCUMENTS

| | | |
|---|---|---|
| 1,384,512 | 7/1921 | Büchi . |
| 1,623,074 | 3/1924 | Tartrais . |
| 1,923,224 | 8/1933 | Moise et al. . |
| 2,669,299 | 2/1954 | Roach . |
| 2,881,828 | 4/1959 | McGinnis . |
| 2,902,153 | 9/1959 | Muller . |
| 3,658,041 | 4/1972 | Lowrey . |
| 3,768,454 | 10/1973 | Markland . |
| 3,768,730 | 10/1973 | Campbell . |
| 4,044,742 | 8/1977 | Linder . |
| 4,180,036 | 12/1979 | Wolf . |
| 4,237,850 | 12/1980 | Connor et al. . |
| 4,279,232 | 7/1981 | Schuster et al. . |
| 4,372,261 | 2/1983 | Sarto . |
| 4,372,279 | 2/1983 | Parks . |
| 4,395,996 | 8/1983 | Davis . |
| 4,397,287 | 8/1983 | Pierard . |
| 4,404,949 | 9/1983 | Bell . |
| 4,473,054 | 9/1984 | Marcoux et al. . |
| 4,477,715 | 10/1984 | Bell et al. . |
| 4,481,931 | 11/1984 | Bruner . |
| 4,489,708 | 12/1984 | Yamamoto et al. . |
| 4,512,324 | 4/1985 | Neary . |
| 4,516,556 | 5/1985 | Meyer . |
| 4,842,006 | 6/1989 | Scheurenbrand . |
| 5,277,166 | 1/1994 | Freeland . |
| 5,303,685 | 4/1994 | Forgacs . |

OTHER PUBLICATIONS

"Dual Draw/Return Fuel System Standard on WhiteGMCs" *Heavy Duty Trucking*, p. 81 (Dec. 1994).

*Primary Examiner*—Carl S. Miller
*Attorney, Agent, or Firm*—Klarquist Sparkman Campbell Leigh & Whinston

[57] ABSTRACT

A fuel system has a fuel tank with a wall and a fuel delivery outlet through which fuel is delivered to the engine. The fuel tank has a fuel suction tube extending from the fuel delivery outlet into the fuel tank. Fuel is drawn to the engine from the fuel tank through the suction tube and the fuel delivery outlet. The fuel tank has a fuel cooling return inlet through which unused fuel warmed by the engine may be returned to the fuel tank and cooled. A fuel cooling conduit is coupled to the fuel cooling return inlet. The fuel cooling conduit has at least one fuel dispersing outlet through which fuel is dispersed onto the fuel tank wall to cool the fuel. A fuel warming return inlet is provided through which unused fuel warmed by the engine may be directed to flow adjacent the suction tube to heat the fuel being delivered through the suction tube to the engine. A shroud may also be provided to blend returning warm fuel with cooler fuel from the fuel tank that is flowing toward the suction tube.

12 Claims, 3 Drawing Sheets

FIG. 4
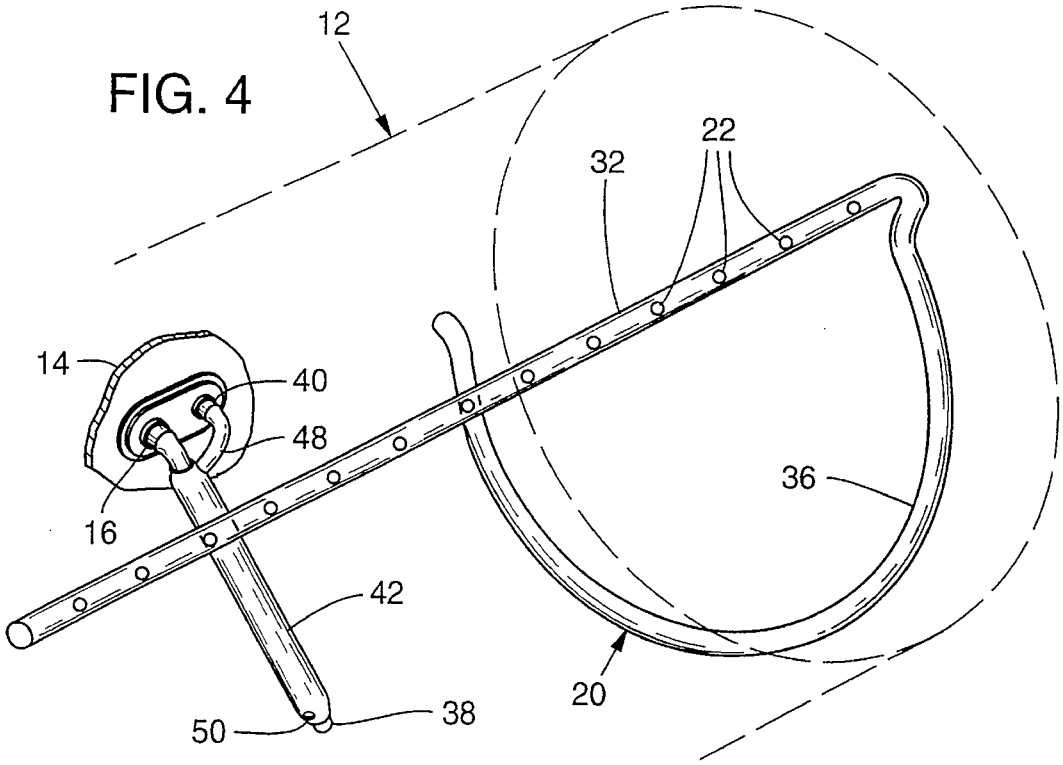
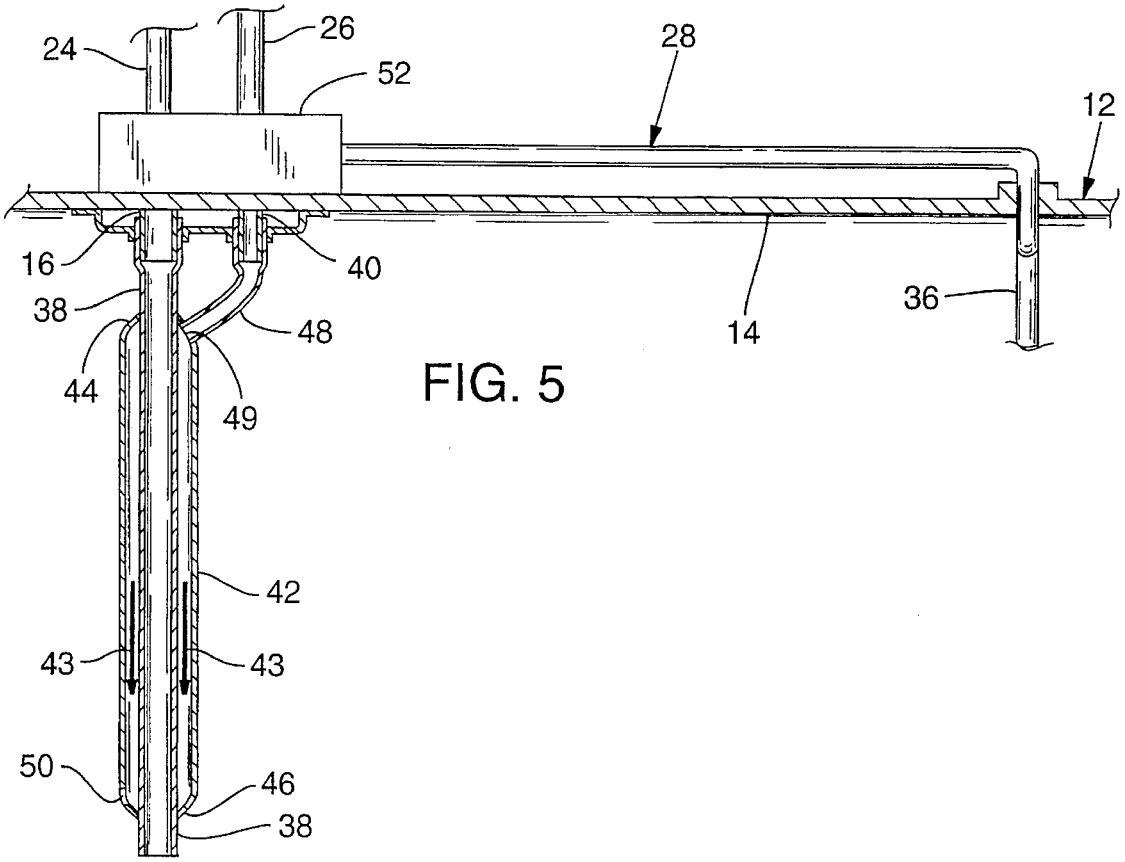
FIG. 5

FUEL SYSTEM FOR HEATING AND COOLING FUEL

This is a continuation of application No. 08/173,667, filed Dec. 23, 1993, now U.S. Pat. No. 5,533,486.

TECHNICAL FIELD

The present invention relates to a fuel system for heating fuel, cooling fuel, or both heating and cooling fuel for the efficient operation of internal combustion engines.

BACKGROUND OF THE INVENTION

Engines, especially diesel engines, operate most efficiently when the fuel delivered to the engines is maintained within a desired temperature range. The low end of the desired range is above low fuel temperatures at which fuel may thicken (wax). The high end of the desired temperature range is below high fuel temperatures at which engine power output deteriorates.

Fuel waxing is apt to occur during cold weather, when the fuel tank of a vehicle is exposed to the environment. Under such conditions, fuel in the fuel tank may thicken. Such thickened fuel may clog the engine fuel inlet lines. The clogging may result in compromised engine performance or engine shutdown. The small fuel lines of electronic fuel injectors prevalent today are especially vulnerable to such clogging.

Engine power output may deteriorate when the fuel being delivered to the engine becomes excessively warm. For example, the power output of diesel engines may decline by one horsepower for every 10° F. of fuel temperature over 100° F. Moreover, over-heated fuel may be detrimental when fuel is used to cool engine equipment, such as in a heat exchange relationship with electronic engine controls. Such over-heated fuel may inadequately cool the engine equipment, resulting in a reduced service life for that equipment.

Fuel tends to become excessively heated when stored in a vehicle fuel tank during very hot weather. Fuel also becomes overheated when used to cool engine equipment. As much as 80% of the fuel directed from the fuel tank to the engine is returned unused (uncombusted) by the engine and is used for equipment cooling as the fuel is returned to the fuel tank. The fuel picks up heat from equipment being cooled, which tends to increase the temperature of the fuel.

Therefore, it is desirable to maintain the fuel delivered from the fuel tank within a temperature range that minimizes problems associated with waxing, degraded power output and inadequate engine equipment cooling.

One prior art approach uses radiators to cool the fuel. However, radiators tend to be expensive and prone to damage. Another approach uses a two fuel tank system to address the problem of hot fuel that is recycled from the engine. The first tank receives the hot recycled fuel for storage and gradual cooling, and the other tank receives cooled fuel from the first tank for delivery to the engine. This approach has a drawback in that, on very warm days, the fuel in the tanks may not cool adequately. Moreover, when the fuel level in the tanks is low, the hot fuel may not be stored in the cooling tank long enough for adequate cooling. Furthermore, these approaches do not address the problem of fuel that is too cold.

Wolf U.S. Pat. No. 4,748,968 discloses a fuel heating device in which relatively hot engine coolant circulates around a fuel tank suction tube to warm fuel taken from the fuel tank. The Wolf device requires a coolant fluid circuit extending between the cooling system and the fuel tank.

Stone U.S. Pat. No. 5,042,447 discloses a thermostatically controlled fuel heater and cooler. The Stone device monitors the fuel temperature and appropriately directs the fuel into a fuel heating heat exchanger utilizing relatively hot engine coolant for heating, or a fuel cooling heat exchanger utilizing a refrigerant for cooling. The coolant and refrigerant of the Stone device circulate through lines which are lifted into the engine cooling system, and the air conditioning system, respectively. Consequently, the Stone device adds to the complexity of these systems.

A need exists for an improved apparatus for temperature control of fuel which overcomes these and other disadvantages of the prior art.

SUMMARY OF THE INVENTION

It is one object of the present invention to provide an improved fuel system for adjusting fuel temperature of fuel utilized by an internal combustion engine.

It is another object of the present invention to either heat fuel utilized by an engine, cool fuel utilized by an engine, or selectively heat or cool fuel utilized by an engine.

A secondary object of the present invention is to provide such a fuel system of simple construction.

Another secondary objective of this invention is to provide a fuel system for fuel cooling and/or heating that is concealed within a fuel tank for protection against damage.

A fuel system in accordance with one aspect of the present invention has a fuel tank with a fuel delivery outlet through which fuel is delivered to an engine. The fuel tank has a fuel cooling return inlet through which unused fuel warmed by the engine is returned to the fuel tank. A fuel cooling conduit may be coupled to the fuel cooling return inlet. The fuel cooling conduit has at least one fuel dispersing outlet through which fuel is dispersed against a heat dissipation surface, such as a wall of the fuel tank, to cool the fuel.

The fuel tank may have a fuel suction tube extending from the fuel delivery outlet into the fuel tank. Fuel is drawn to the engine from the fuel tank through the suction tube and the fuel delivery outlet. The tank has a fuel warming return inlet through which unused fuel warmed by the engine may be returned to the fuel tank. The warmed fuel may be guided by a fuel flow guide to blend with and heat fuel from the tank which is then delivered to the fuel delivery outlet and to the engine. Preferably, the unused warm fuel passes in heat transfer relationship to the suction tube so as to heat the fuel in the suction tube.

In accordance with another aspect of the present invention, a shroud may be provided over a portion of the fuel warming conduit and suction tube. The shroud defines a blending chamber in which heated fuel returning from the engine is blended with cooler fuel from the fuel tank. The warm fuel blend is then directed into the suction tube for delivery to the engine.

The present invention relates to the above-described objects and features individually, as well as collectively. These and other features, objects and advantages of the present invention will become apparent with reference to the following description and drawings.

BRIEF DESCRIPTION OF DRAWINGS

FIG. 4 is a cutaway perspective view of the fuel system in accordance with one preferred embodiment of the present invention, with the outline of a portion of a fuel tank being shown in dashed lines.

FIG. 5 is a cutaway, cross-sectional side elevational view of a fuel system in accordance with one preferred embodiment of the present invention.

DETAILED DESCRIPTION

Figure 1:
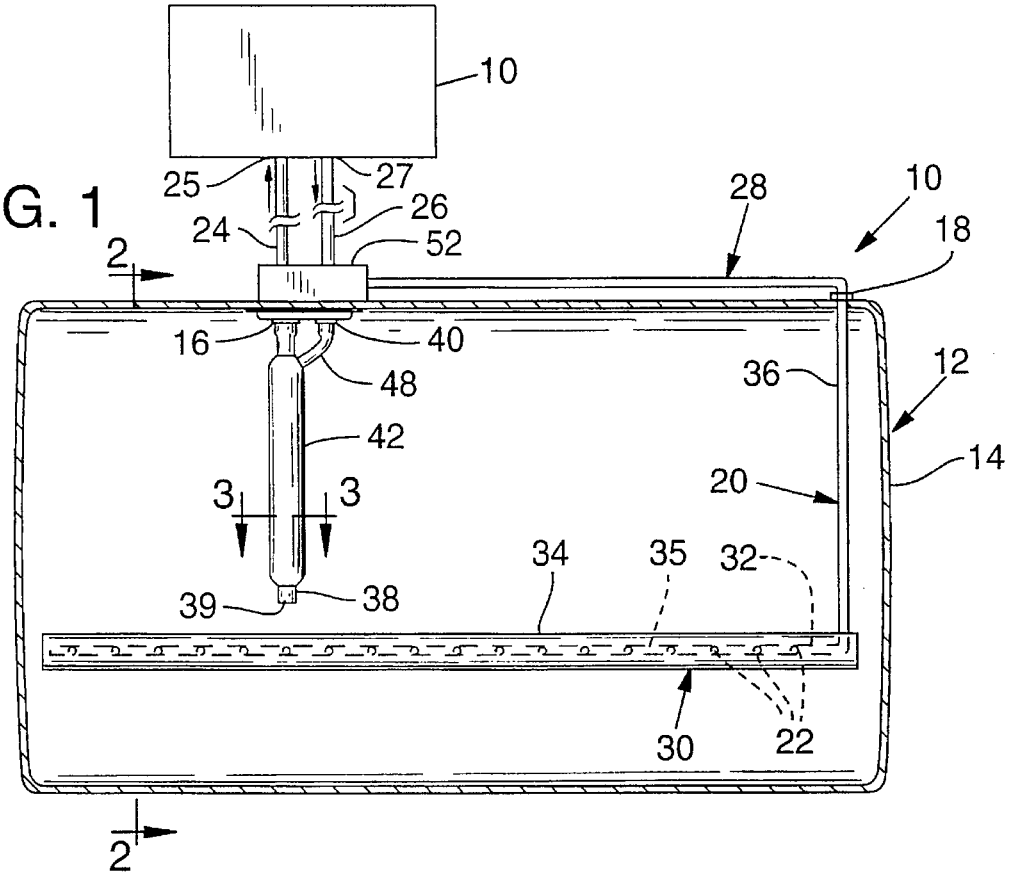
FIG. 1 is a cross-sectional side elevational view of a fuel system in accordance with one preferred embodiment of the present invention.

As shown generally in FIG. 1, a fuel system for an engine 10 of a motor vehicle has a fuel tank 12 with a wall 14. The fuel tank 12 is preferably cylindrical and elongated in a length dimension. The fuel tank may be attached longitudinally beneath the cab or otherwise mounted to the motor vehicle (not shown). However, it is to be understood that the present invention is applicable to any fuel tank geometry, location, or orientation.

Fuel is delivered from the fuel tank 12 to the engine 10 through a fuel delivery outlet 16. A fuel suction tube 38 typically extends from the fuel delivery outlet 16 downwardly toward the bottom of the fuel tank 12. The fuel suction tube 38 has a suction inlet 39. Fuel is drawn from the fuel tank 12 through the suction inlet 39 and the suction tube 38 for delivery to the engine. A fuel delivery conduit 24 coupled to the fuel delivery outlet 16 carries fuel from the fuel delivery outlet 16 to an engine fuel inlet 25 of the engine. A fuel return conduit 26 is provided for returning unused fuel from an engine fuel return outlet 27 to the fuel tank 12.

The returning warmed fuel may be delivered to a fuel cooling subsystem, to a fuel warming subsystem, or selectively delivered to either the warming subsystem or the cooling subsystem depending upon fuel temperature. In tropical or other warm climates, the fuel warming subsystem may be eliminated similarly, in arctic or other cold climates, the cooling subsystem may be eliminated. In other climates or applications, both warming and cooling subsystems may be included in combination with a mechanism for directing fuel between the warming and cooling subsystems depending upon the temperature of the fuel being delivered to the engine.

One such fuel flow directing mechanism comprises a valve 52. Valve 52 preferably comprises a temperature sensitive valve which delivers returning fuel to either a fuel cooling return inlet 18 or a fuel warming return inlet 40. In one preferred embodiment, the fuel warming return inlet 40 and the fuel delivery outlet 16 are positioned adjacent each other. Together, they are spaced apart from the fuel cooling return inlet 18, in this case located adjacent to one end of the fuel tank 12.

In accordance with one aspect of the present invention, the fuel system cools unused fuel that has been warmed by the engine, or engine equipment such as the electronic engine controls (not shown). In accordance with this aspect of the invention, a cooling subsystem is provided to cool the fuel. In one illustrated form, such a cooling subsystem may include a fuel cooling conduit 20 which is coupled to the fuel cooling return inlet 18. The fuel cooling conduit 20 includes an external fuel cooling tube 28, although tube 28 may be positioned inside the fuel tank, and a fuel dispersion portion 30. The illustrated fuel dispersion portion 30 has a fuel dispersion tube 32 with a plurality of fuel dispersion outlets 22 that preferably comprise conventional spray nozzles. For maximum efficiency, the fuel dispersion tube typically extends along about the entire length of the tank. Also, the nozzles are typically spaced an equal distance apart along the dispersion tube. For example, a 150 gallon fuel tank is typically about five and one-half feet long. In such a case, the dispersion tube may be about five feet long. Of course, it may be longer or shorter and need not be straight. Any number of nozzles may be used, providing that they are capable of spraying the volume of fuel returned from the engine. For example, a Detroit Diesel Series 60 engine at idle returns about 1.1 gallons of fuel per minute to the fuel tank. Therefore, if ten nozzles are used, each typically can deliver at least 0.11 gallons of fuel per minute at ordinary engine operating fuel pressures. Typically, the nozzles have an identical fuel delivery capacity, although this is not necessary. Also, the nozzles are typically oversized somewhat to have the capacity to deliver in excess of the maximum fuel that a particular engine will return to the fuel tank.

The fuel dispersion tube portion 32 extends along the length dimension of the fuel tank 12 near the top of the fuel tank (FIGS. 1 and 4). The nozzles are configured to direct fuel toward the fuel tank wall 14. Preferably, the nozzles spray the warm return fuel onto the fuel tank wall 14 near the top of the tank 12. The fuel tank wall 14 acts as a heat sink to cool the warm fuel as the fuel drains down the wall 14 to the level of the fuel stored within the tank 12. Spraying the warm fuel onto a top portion of the wall 14 increases the cooling of the fuel because the heat transfer of the fuel to the fuel tank wall 14 tends to increase as the drainage distance increases. Alternatively, the wall 14 may be in the form of a heat dissipation element, such as a plate, baffle or other surface, supported within the tank 12.

This specific embodiment also has an advantage in that fuel will drain over a greater distance down the fuel tank wall 14 as the level of fuel in the fuel tank 12 decreases. This increase in fuel cooling tends to counteract the decrease in fuel cooling associated with the shorter dwell time of fuel in the fuel tank storage when the tank fuel level is low.

In the embodiment shown in FIG. 1, the fuel dispersion portion 30 has an elongate frame or bracket 34 that supports the fuel dispersion tube 32 along the length dimension of the fuel tank 12. The bracket 34 has a flange 35 that is mounted to the fuel tank wall 14, above the fuel dispersion tube 32, by welding or any suitable fasteners. The bracket 34 is spaced from the fuel tank wall 14 and is positioned to support the fuel dispersion tube 32 from below. The fuel dispersion tube 32 is therefore supported in close proximity to the fuel tank wall and the nozzles 22 are oriented to spray fuel upwardly onto the fuel tank wall. The sprayed fuel drains down the wall 14, unimpeded by the elongate frame 34.

It is to be understood that the fuel cooling subsystem of the present invention may take a variety of forms, for example, the fuel dispersion tube 32 may directly abut the fuel tank wall 14 so that warm return fuel flows directly onto the fuel tank wall for drainage. Any technique for dispersing the warm return fuel upon the fuel tank wall 14 or another heat dissipation surface is within the scope of this invention.

Figure 2:
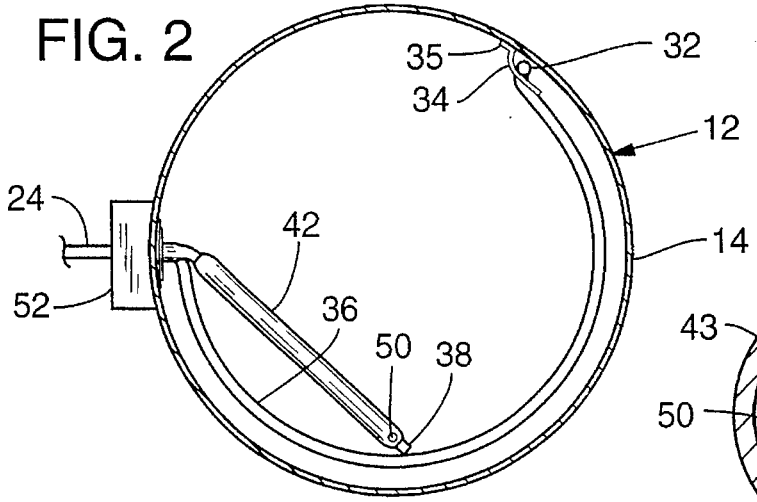
FIG. 2 is a cross-sectional end view of the fuel system in accordance with one preferred embodiment of the present invention, taken along line 2—2 of FIG. 1.

The fuel cooling tube 28 also includes a connecting tube portion 36, which, in the illustrated embodiment, extends from the fuel cooling return inlet 18 to the fuel dispersion tube portion 32. As seen in FIGS. 1, 2 and 4, the connecting tube portion 36 extends downwardly from the fuel cooling return inlet 18 in an arcuate path, transversely across the bottom of the fuel tank 12, and upwardly along the wall 14 at the opposite side of the fuel tank. Near the top of the fuel tank 12, the connection tube portion 36 connects with the fuel dispersion tube 32.

If the tank 12 is conventionally mounted longitudinally upon the vehicle, the fuel dispersion tube portion 32 is preferably mounted near the top of the outboard half of the fuel tank 12. In this way, the spray is directed to the outboard portion of the wall 14 of the fuel tank 12. The outboard portion of the fuel tank wall 14 is typically better exposed to the ambient air and to air flow when the vehicle is moving, thus enhancing the heat sink characteristics of the heat dissipation surface. To further increase the cooling of the fuel, it may be desirable to configure or treat the exterior of the fuel tank to increase the radiative, convective, and/or conductive heat transfer from the fuel tank wall to the ambient environment. For instance, a polished silver-colored fuel tank surface provides excellent radiative heat transfer. The capacity of the fuel of the subject fuel system to cool equipment improves with the increased transfer of heat from the fuel tank to the ambient.

The interior wall of the fuel tank may also be configured in a variety of ways to improve fuel cooling. For instance, it may be desired to increase the drainage time of the fuel down the fuel tank wall. In this case, a roughened wall surface may serve to slow the drainage of fuel.

The cooling subsystem of the fuel system of the present invention has other advantages. The present cooling system is of simple construction, dispensing with the radiators and extensive coolant circuitry of the prior art. The present cooling system is also relatively invulnerable to damage in that the surrounding fuel tank wall 14 acts as shield to protect the cooling subsystem.

In accordance with another aspect of the present invention, the fuel system may include a fuel warming subsystem to warm fuel being delivered from the fuel tank 12 to the engine during cold conditions, to thereby minimize fuel waxing problems. As best shown in FIG. 5, such a warming subsystem may include a fuel warming conduit 42 connected to the fuel warming return inlet 40 to act as a heat exchanger. Heat is transferred from warm fuel passing through the fuel return inlet 40 to fuel flowing toward the engine within the suction tube 38. Suction tube 38 is typically of metal to enhance this heat transfer.

The illustrated fuel warming conduit 42 is a relatively large-diameter straight tube that surrounds a substantial length of the straight, relatively small-diameter suction tube 38. The fuel warming conduit 42 defines a warm fuel return path 43 between the suction tube 38 and the fuel warming conduit 42. The fuel warming conduit 42 has first and second diametrically tapering ends 44, 46 that are attached to respective end portions of the suction tube 38. The tapering ends 44, 46 may be attached to the suction tube 38 in a variety of ways, including welds or interference fits. A fuel warming connector tube 48 extends from the fuel warming return inlet 40 into an inlet aperture 49 on the proximate or first tapering end 44 of the fuel warming conduit 42. A fuel warming outlet aperture 50 is provided through the fuel warming conduit 42 near the distal or second tapering end 46.

Thus, warm fuel returning from the engine passes through the fuel warming return inlet 40, the fuel warming connector 48, the warm fuel return path 43 defined in this case between the suction tube and the fuel warming conduit 42, and the fuel warming outlet aperture 50 before flowing into the interior of the fuel tank 12.

Figure 3:
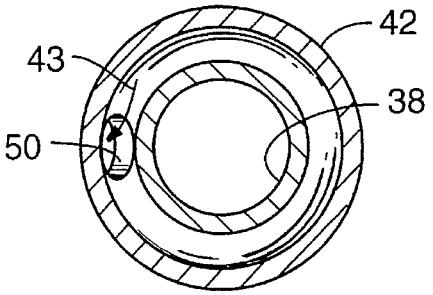
FIG. 3 is a cross-sectional view of a fuel warming portion of a fuel system in accordance with one preferred embodiment of the present invention, taken along line 3—3 of FIG. 1.

As shown in FIG. 3, the cross-sectional area of the warm fuel return path 43 is greater than the cross-sectional area within the suction tube 38. The flow rate of the returning fuel in the warm fuel return path 43 is also less than the fuel flow rate in the suction tube 38, due to the engine using some of the fuel. Therefore, the velocity of the warm fuel flowing through the warm fuel return path 43 is less than the velocity of the fuel flow in the suction tube 38.

It is to be understood that these fuel flow velocities may be varied in alternative embodiments. As the cross-sectional area of the suction tube 38 is increased, the suction tube 38 fuel flow velocity will decrease. This will increase the time of exposure of the cool fuel in the suction tube 38 to the warm fuel in the warm fuel return path 43. The fuel being delivered to the engine would thus tend to be heated more. All permutations of the fuel flow rates, and suction tube and warm fuel return path geometries, fall within the scope of this invention.

The warm fuel return path configuration may be modified in further ways. For instance, instead of the fuel warming conduit 42 completely surrounding a length of the suction tube 38, the fuel warming conduit may be in the form of a helix winding around the fuel suction tube 38. Any embodiment in which the fuel warming return inlet 40 directs fuel to flow adjacent to the suction tube such that fuel warmed by the engine and returning to the fuel tank heats the fuel being delivered to the engine through the suction tube 38 falls within the scope of this invention.

Figure 6:
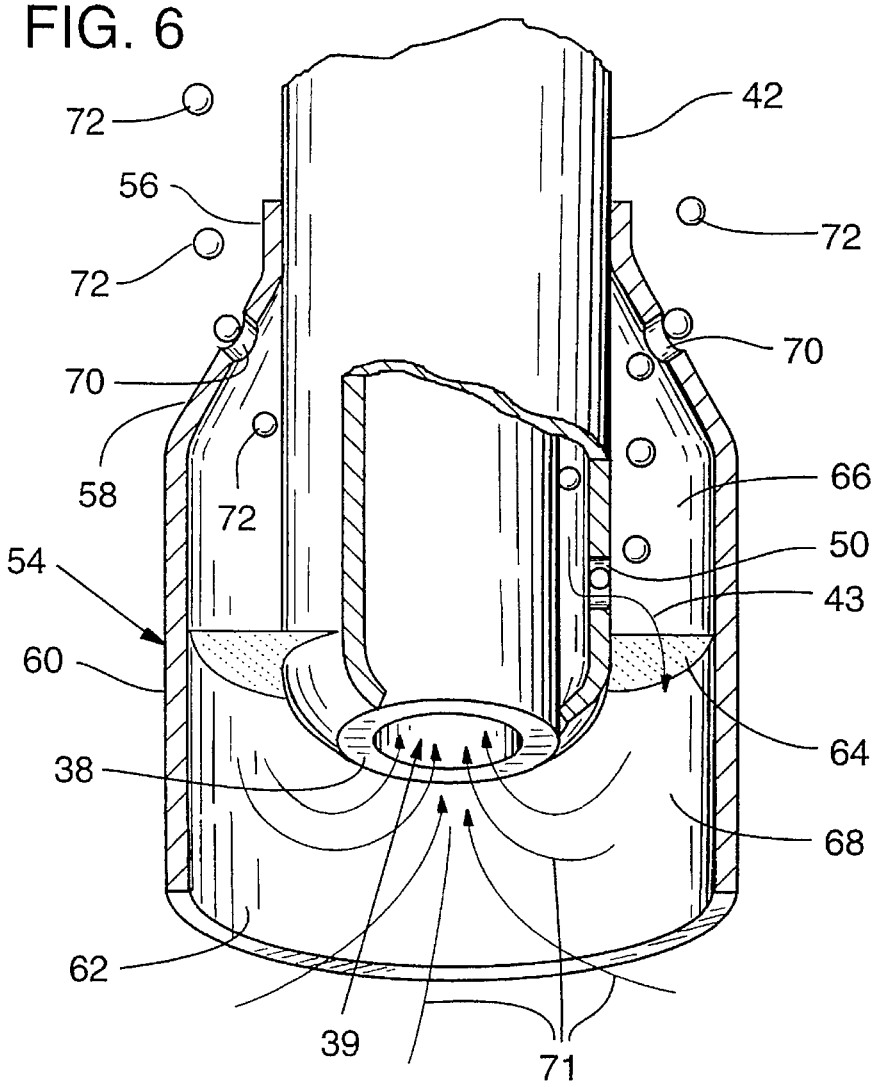
FIG. 6 is a cutaway side elevational view of the fuel system in accordance with a preferred embodiment of the present invention, showing the provision of an optional shroud.

In accordance with another aspect of the present invention, shown in FIG. 6, a shroud 54 may be provided over a portion of the fuel warming conduit 42 and suction tube 38. The shroud 54 defines one form of a fuel blending or mixing chamber at the distal end of the suction tube 38. The heated fuel is blended in this chamber with cooler fuel from the fuel tank 12 that is about to enter the suction tube inlet 39 along a suction path 71. The fuel blend then moves along the suction path 71 into the suction tube 38 for delivery to the engine. As seen in FIG. 6, the shroud 54 extends downwardly into the tank 12 from an attachment position on the fuel warming conduit 42 which is spaced above the fuel warming outlet aperture 50. The end of the fuel suction tube 38 may be flush with the end of the fuel warming conduit 42.

The shroud 54 has a relatively small-diameter cylindrical attachment portion 56 for attachment around the fuel warming conduit 42, an intermediate frustoconical portion 58 of a gradually increasing diameter moving downwardly along the shroud, and a relatively large-diameter cylindrical shroud portion 60. The large cylindrical shroud portion 60 extends from the frustrum portion 58 to an open base 62 located beyond the ends of the respective fuel suction tube 38 and the fuel warming conduit 42.

The shroud attachment portion 56 is typically welded to the fuel warming conduit 42. However, it is to be understood that other attachment approaches, such as interference fits, or fasteners, such as clamps, may be used.

An annular screen 64 extends laterally across the space between the exterior of the fuel warming conduit 42 and the interior of the cylindrical shroud portion 60. The screen 64 is attached to the fuel warming conduit 42 at a position between the fuel outlet aperture 50 and the end of the conduit 42. As a result, the screen 64 divides the interior of the shroud 54 into an inner warm fuel receiving portion 66 and a blending portion 68. The warm fuel receiving portion 66 includes the frustrum portion 58 and that portion of the large cylindrical shroud portion 60 between the screen 64 and the frustrum portion 58. The blending portion 68 includes that portion of the large cylindrical shroud portion 60 from the screen 64 to the base 62. The fuel receiving portion 66 receives the warm fuel exiting through the fuel warming outlet aperture 50. The warm fuel then passes through the screen 64 along the warm fuel return path 43 to the blending portion 68.

The blending portion 68 defines a blending space wherein the warm fuel return path 43 and the suction path 71 converge. The blending space includes the space within the blending portion 68 and the space in the fuel tank 12 immediately outside the open base 62 of the shroud 54. Within the blending space, a portion of the warm fuel within the warm fuel return path 43 blends into the cool fuel of the suction path 71. The blending yields a fuel blend with an intermediate temperature that is higher than the temperature of the cool fuel in the fuel tank 12, and lower than the temperature of the warm return fuel. The fuel blend moves along the suction path 71 and is drawn into the suction inlet 39.

The shroud frustrum portion 58 is provided with vapor apertures 70 that provide a second path of movement for the warm return fuel out of the fuel receiving portion 66. A preferred embodiment has four vapor apertures 70 positioned at 90° intervals about the frustrum portion 58. The vapor apertures 70 are positioned above the fuel warming conduit outlet aperture 50. This arrangement permits fuel vapor bubbles 72, which may be present in the warm fuel returning from the engine, to rise and pass through the vapor apertures 70 and into the fuel tank 12. The screen 64 minimizes the risk of large fuel vapor bubbles 72 passing into the blending chamber 68 and being drawn into the fuel suction tube 38 and delivered to the engine.

Although variable, the screen 64 preferably has around one-hundred openings per square inch. The screen 64 retards the flow of warm return fuel between the receiving portion 66 and the blending portion 68 and enhances the escape of vapor bubbles through the vapor apertures 70. The warm fuel flow along the second path tends to heat the cool ambient fuel in the fuel tank 12. It is to be understood that the vapor and fuel flow apertures may be varied in size, shape, and number with equally good results. As a specific example, the fuel flow aperture may be about 0.31 inches in diameter and each of the vapor apertures may be about 0.13 inches in diameter.

The blending of the warm return fuel and the cool fuel within the blending chamber is advantageous in that warmed fuel is delivered to the engine rapidly after engine start-up. This blending chamber may be located elsewhere in the fuel tank than at the end of a suction tube and may be located outside of the fuel tank. The mixing of warm fuel returning from the engine directly with fuel being delivered to the engine decreases the rate of heating of the remaining fuel stored in the fuel tank 12. The blending of warm and cool fuel also increases the steady state temperature of the fuel being delivered to the engine. Therefore, fuel blending results in the delivery of warmer fuel to the engine, while the fuel remaining in the tank remains a little cooler.

The fuel blending aspect of the present invention can be accomplished in a variety of ways. For example, an outlet for warmed fuel returning from the engine may be placed adjacent a suction outlet for fuel being delivered to the engine. The blending of warm return fuel and cool fuel in the fuel tank may be accomplished in other ways, providing the warm returning fuel is at least partially mixed with cooler fuel from the fuel tank being delivered to the engine.

Figure 7:
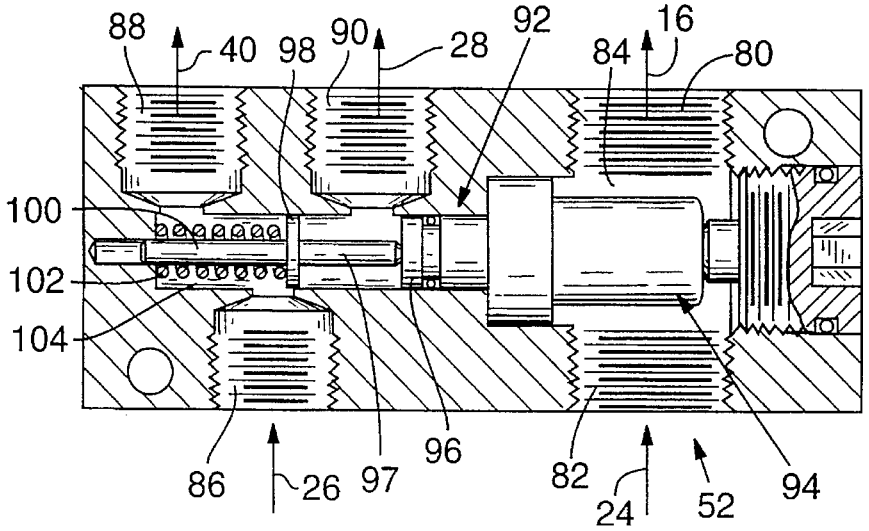
FIG. 7 is a cross-sectional view of one form of valve suitable for use in embodiments of the present invention.

In accordance with an aspect of one embodiment of the present invention, the fuel system has an optional valve 52 which operates to direct the flow of fuel returning from the engine between the fuel cooling return inlet 18 and the fuel warming return inlet 40. One suitable form of valve 52 is shown in FIG. 7. Valve 52 includes first and second warm fuel return ports 80, 82 which are coupled respectively to the fuel delivery outlet 16 and fuel delivery conduit 24. A passageway 84 between ports 80, 82 remains open to supply fuel from the suction tube to the engine. The valve also has a warm fuel receiving port 86 for coupling to the return fuel line 26, a warm fuel return port 88 for coupling to the warm fuel inlet 40 and a cooling fuel port 90 for coupling to the cooling conduit 28. A temperature sensitive flow control valve 92 selectively controls the flow of returning fuel between the ports 88, 90 and thus the flow of fuel between the fuel warming and cooling subsystems. The valve 92 includes a temperature responsive actuator, such as a wax pallet 94 manufactured by Robert Shaw Company of Chicago, Ill. As the fuel temperature in passageway 84 rises, the fuel begins to melt wax in pallet 94. As the wax is heated, it expands and causes a piston 96 to shift to the left in FIG. 7. As piston 96 shifts to the left, it engages a stem 97 which supports a valve disk 98. The stem 97 is slidably mounted to a rod 100. A coil spring or other biasing element 102 biases the disk 98 to the position shown in FIG. 7. In FIG. 7, a cool fuel condition, warm fuel flows from port 86 through a passageway 104 and to the port 88. The disk 98 substantially blocks the flow of fuel to the port 90 and thus to the cooling subsystem. As the fuel warms, the disk 98 is shifted to the left and opens the flow path between ports 86 and 90 through passageway 104. Although not necessary, the illustrated valve 92 has an intermediate position where fuel simultaneously flows between ports 86 and 88 as well as between ports 86 and 90. This simultaneous flow of fuel is cut off when disk 98 is shifted to the left of port 86 in FIG. 7.

The valve 52 therefore comprises a temperature, 15 sensitive valve which directs fuel to the fuel cooling return inlet 18 when the temperature of the fuel at the fuel delivery outlet 16 is above a first predetermined magnitude. The temperature-sensitive valve directs fuel to the fuel warming return inlet 40 when the fuel temperature of the fuel at the fuel delivery outlet 16 is below a second predetermined magnitude.

In a preferred embodiment, the first predetermined magnitude is about 80° F. When the fuel temperature at the fuel delivery outlet rises above 80° F., the temperature-sensitive valve actuates to direct fuel to the fuel cooling return inlet 18 and thus to the fuel cooling subsystem.

The second predetermined magnitude in the preferred embodiment is about 60° F. When the fuel at the fuel delivery outlet 16 falls below 60° F., the temperature-sensitive valve directs the warm returning fuel to the fuel warming return inlet 40 and thereby to the fuel warming subsystem. Between 60° F. and 80° F., the fuel is diverted to both the fuel heating and fuel cooling subsystems, with more of the fuel being delivered to the cooling subsystem as fuel temperature rises, and vice versa.

The valve may take the form of a binary valve in that the entire flow of return fuel may be delivered only to the fuel cooling return inlet 18 or the fuel warming return inlet 40, depending on fuel temperature.

It is to be understood that other valves or flow diverters may be used with this invention. For instance, the valve may be manually activated (remotely from the cab of a vehicle or by a manual switch on the valve). Also, the valve may take the form of a solenoid operated valve which is operated in response to sensed fuel temperature.

It is to be understood that the first and second predetermined magnitudes are exemplary only. These temperatures may be modified for different grades of fuel, including diesel fuel, kerosene, and gasoline. The fuel system of the present invention is applicable to any type of internal combustion engine, but has particular applicability to diesel engines. The fuel cooling feature is also particularly applicable to gasoline engines.

Again, it is to be understood that the heating and cooling aspects of this invention may be separately provided or provided in combination. For example, in hot climates, only fuel cooling may be necessary.

This detailed description is set forth only for purposes of illustrating examples of the present invention and should not be considered to limit the scope of the claims to the invention in any way. Numerous additions, substitutions, and modifications can be made to these examples without departing from the scope of the invention.

I claim any and all modifications that fall within the scope of the following claims:

1. A fuel system for an engine of a motor vehicle comprising:

a fuel tank;

a fuel delivery flow path along which fuel from the fuel tank is delivered to an engine;

a fuel return flow path along which unused fuel warmed by the engine is returned to the fuel tank; and a fuel cooling heat exchanger in the fuel tank, the heat exchanger being in the fuel return flow path in a position to receive fuel returning to the fuel tank and to cool the returning fuel, the fuel cooling heat exchanger being separated from the fuel delivery flow path so as to avoid blending in the heat exchanger of returning fuel with fuel being delivered to the engine.

2. A fuel system for an engine of a motor vehicle comprising:

an elongated fuel tank having a longer length dimension and also having a wall, a fuel delivery outlet through which fuel flows to the engine, and a fuel cooling return inlet through which unused fuel warmed by the engine may be returned to the fuel tank from the engine; and a fuel cooling conduit coupled to the fuel cooling return inlet, the fuel cooling conduit having plural fuel dispersing outlets oriented to direct returning fuel toward the wall at a top portion of the fuel tank and at plural locations spaced along the length dimension of the tank.

3. A fuel system according to claim 2 in which the fuel cooling conduit includes a nozzle at plural of the fuel dispersing outlets through which fuel is sprayed toward the fuel tank wall.

4. A fuel system for an engine of a motor vehicle comprising:

a fuel tank having a wall, a fuel delivery outlet through which fuel flows to the engine, and a fuel cooling return inlet through which unused fuel warmed by the engine may be returned to the fuel tank from the engine, the fuel cooling return inlet being spaced from the fuel delivery outlet; and a fuel cooling conduit coupled to the fuel cooling return inlet, the fuel cooling conduit having at least one fuel dispersing outlet through which fuel is dispersed toward the wall at an upper portion of the fuel tank so as to impinge against the tank wall and drain down the surface of the tank wall and into fuel in the tank to cool the fuel.

5. A fuel system for an engine of a motor vehicle comprising:

a fuel tank having an interior defined by a wall, a fuel delivery outlet through which fuel flows to the engine, and a fuel return inlet through which unused fuel warmed by the engine is returned to the fuel tank;

the fuel tank including a heat dissipation surface within the fuel tank;

a fuel cooler coupled to the return inlet to receive fuel warmed by the engine, the fuel cooler including at least one outlet oriented to directing received warmed fuel against the heat dissipation surface within the fuel tank to cool the fuel.

6. A fuel system according to claim 5 in which the fuel tank is elongated and has a length dimension and in which the heat dissipation surface extends along the length division of the fuel tank.

7. A fuel system according to claim 6 in which the heat dissipation surface includes a surface of the wall positioned at the outboard side of the tank.

8. A fuel system according to claim 6 in which the heat dissipation surface includes an elongated portion of the upper surface of the wall of the tank.

9. A fuel system according to claim 5 in which the cooler includes plural nozzles through which warm fuel is sprayed against the wall of the tank and through the space in the tank above the fuel level when the tank is partially empty.

10. A fuel system for an engine of a motor vehicle of the type in which unused warm fuel from an engine is returned to a fuel tank, the system comprising:

a conduit positioned to receive warm fuel returning to the tank, a plurality of nozzles coupled to the conduit and oriented to spray returning warm fuel within the tank to disperse heat from the fuel.

11. A fuel system according to claim 10 in which the conduit has a plurality of nozzles spaced along the conduit.

12. A fuel system according to claim 10 in which the fuel tank has a heat dissipation surface against which the nozzles spray the returning warm fuel.

* * * * *

UNITED STATES PATENT AND TRADEMARK OFFICE

CERTIFICATE OF CORRECTION

PATENT NO. : 5,601,066

DATED : February 11, 1997

INVENTOR(S) : Qutub

It is certified that error appears in the above-indentified patent and that said Letters Patent is hereby corrected as shown below:

On the title page, item [56]:

In the References Cited:

U.S. Patent Documents, "4,481,931" should be --4,491,931--

In the Specification:

Col. 2, line 9, "lifted" should be --linked--

Col. 8, line 43, "temperature, 15 sensitive" should be --temperature-sensitive--

Signed and Sealed this

Seventh Day of October, 1997

Bruce Lehman

*Attest:*

BRUCE LEHMAN

*Attesting Officer*

*Commissioner of Patents and Trademarks*